US009730569B2

(12) United States Patent
Huang et al.

(10) Patent No.: US 9,730,569 B2
(45) Date of Patent: Aug. 15, 2017

(54) WOVEN FABRIC FOR MOP CLOTH

(71) Applicant: DYNA-MOP, INC., Taipei (TW)

(72) Inventors: Yuan-Hou Huang, Changhua County (TW); Ta-Fu Lin, Taichung (TW)

(73) Assignees: DYNA-MOP, INC., Taipei (TW); Yuan-Hou Huang, Changhua County (TW); Victor T. Hou, Las Vegas, NV (US)

( * ) Notice: Subject to any disclaimer, the term of this patent is extended or adjusted under 35 U.S.C. 154(b) by 0 days.

(21) Appl. No.: 14/847,641

(22) Filed: Sep. 8, 2015

(65) Prior Publication Data

US 2016/0083874 A1 Mar. 24, 2016

(30) Foreign Application Priority Data

Sep. 19, 2014 (TW) ..... 103132496

(51) Int. Cl.

| | |
|---|---|
| ***A47L 13/20*** | (2006.01) |
| ***D03D 1/00*** | (2006.01) |
| ***D03D 15/00*** | (2006.01) |

(52) U.S. Cl.

CPC ..... *A47L 13/20* (2013.01); *D03D 1/0023* (2013.01); *D03D 15/0033* (2013.01); *D03D 15/0077* (2013.01); *D10B 2331/04* (2013.01)

(58) Field of Classification Search

CPC .. A47L 13/20; D03D 1/0023; D03D 15/0033; D03D 15/0077

See application file for complete search history.

(56) References Cited

U.S. PATENT DOCUMENTS

| | | | | |
|---|---|---|---|---|
| 2,176,095 | A * | 10/1939 | Muckenhirn | A47L 13/20 15/229.1 |
| 5,178,630 | A * | 1/1993 | Schmitt | A61F 2/06 623/1.33 |
| 2008/0163952 | A1* | 7/2008 | Huang | D03D 13/00 139/317 |

* cited by examiner

*Primary Examiner* — Randall Chin

(57) ABSTRACT

A woven fabric for a mop cloth contains: at least one wrap yarn broadwise woven by a plurality of fibers, plural first fiber yarns, and plural second fiber yarns. Each second fiber yarn is a textured yarn, and each first fiber yarn is a grey yarn. A length of each first fiber yarn is equal to or is more than that of each second fiber yarn, such that two thread ends of each first fiber yarn extends out two sides of each at least one wrap yarn. Thereby, the woven fabric contains a single material or plural materials (such as the grey yarn with a predetermined hardness and the textured yarn with a predetermined flexibility) to absorb fluids and to scrape objects on the floor, thus enhancing cleaning capacity.

5 Claims, 4 Drawing Sheets

WOVEN FABRIC FOR MOP CLOTH

FIELD OF THE INVENTION

The present invention relates to a woven fabric for a mop cloth which contains fiber yarns of different types and lengths to form an elongated woven fabric, thus absorbing fluids and scraping objects on a floor to enhance cleaning capacity.

BACKGROUND OF THE INVENTION

A conventional mop cloth is made of cotton yarns, fiber yarns or non-woven material to absorb fluids strongly. In use, the conventional mop cloth is dipped into dips waters first then is dried to adhere dusts and to clean spots on a floor.

However, such mop cloth can't remove furs, hairs, and chips from the floor, thus making cleaning in effectiveness.

To overcome such a problem, at least one fiber yarn at a predetermined flexibility is processed to attach objects.

But the at least one fiber yarn is puffy, so it cannot scrape chips on the floor.

The present invention has arisen to mitigate and/or obviate the afore-described disadvantages.

SUMMARY OF THE INVENTION

The primary object of the present invention is to provide a woven fabric for a mop cloth which contains fiber yarns of different types and lengths to form an elongated woven fabric, thus absorbing fluids and scraping objects on a floor to enhance cleaning capacity.

To obtain the above objects, a woven fabric for a mop cloth provided by the present invention contains: at least one wrap yarn, plural first fiber yarns, and plural second fiber yarns.

Each second fiber yarn is a textured yarn, and each first fiber yarn is a grey yarn. A length of each first fiber yarn is equal to or is more than that of each second fiber yarn, such that two thread ends of each first fiber yarn extends out of the at least one wrap yarn.

Thereby, the woven fabric of the present invention contains a single material or plural materials (such as the grey yarn with a predetermined hardness and the textured yarn with a predetermined flexibility) to absorb fluids and to scrape objects on the floor, thus enhancing cleaning capacity.

BRIEF DESCRIPTION OF THE DRAWINGS

FIG. 2A is a plan view showing a part of the assembly of the woven fabric for the mop according to the preferred embodiment of the present invention, wherein FIG. 2B is a magnified view of the referred section of FIG. 2A, and FIG. 2C and FIG. 2D are the magnified views of the respective sections referred in FIG. 2B.

FIG. 4A is a plan view showing the assembly of a woven fabric for a mop cloth according to another preferred embodiment of the present invention, wherein FIG. 4B is a magnified view of the referred section of FIG. 4A, and FIG. 4C and FIG. 4D are the magnified views of the respective sections referred in FIG. 4B.

DETAILED DESCRIPTION OF THE PREFERRED EMBODIMENTS

Figure 1:
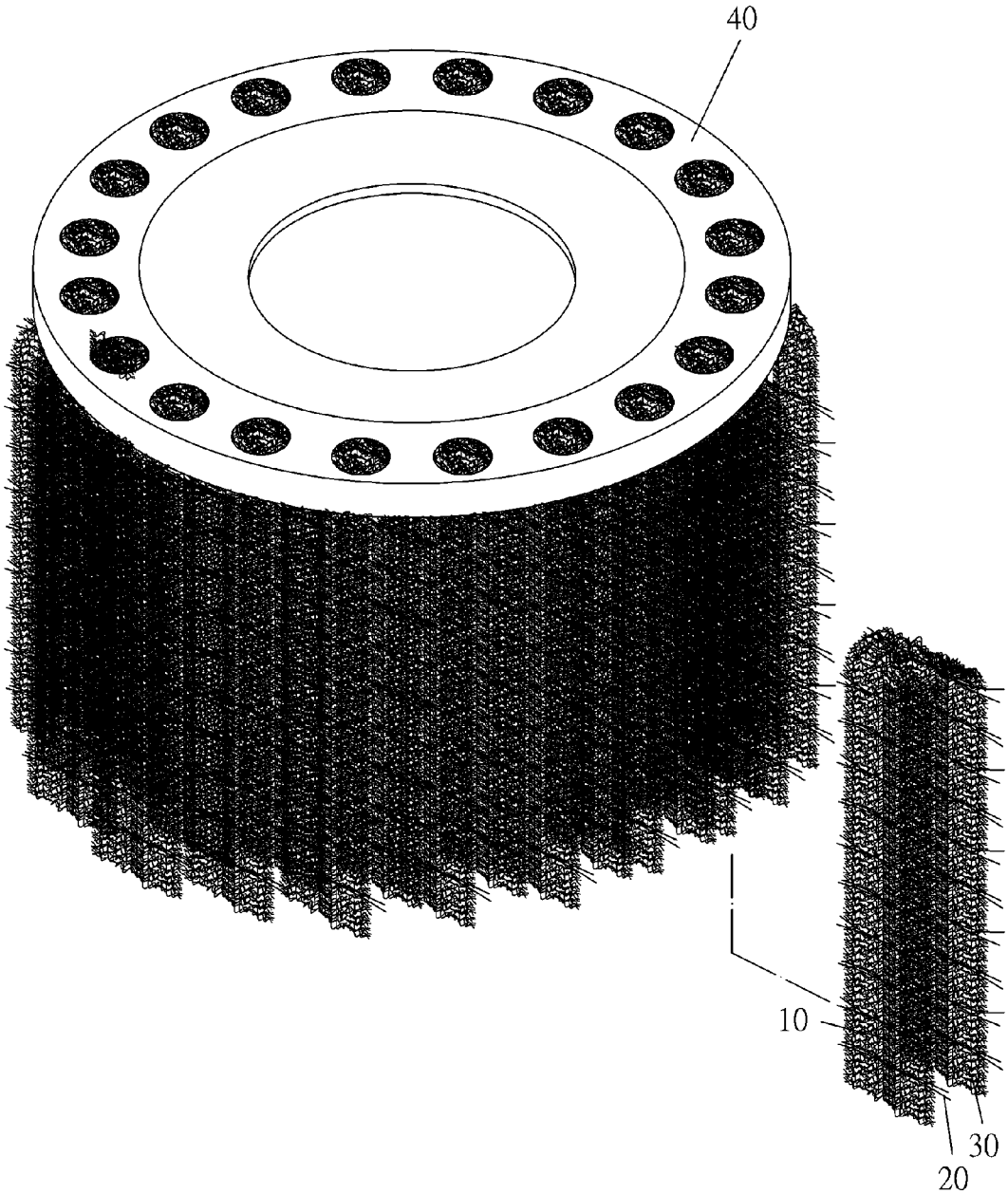
FIG. 1 is a perspective view showing the assembly of a woven fabric for a mop cloth according to a preferred embodiment of the present invention.
Figures 2A, 2B, 2C, 2D:
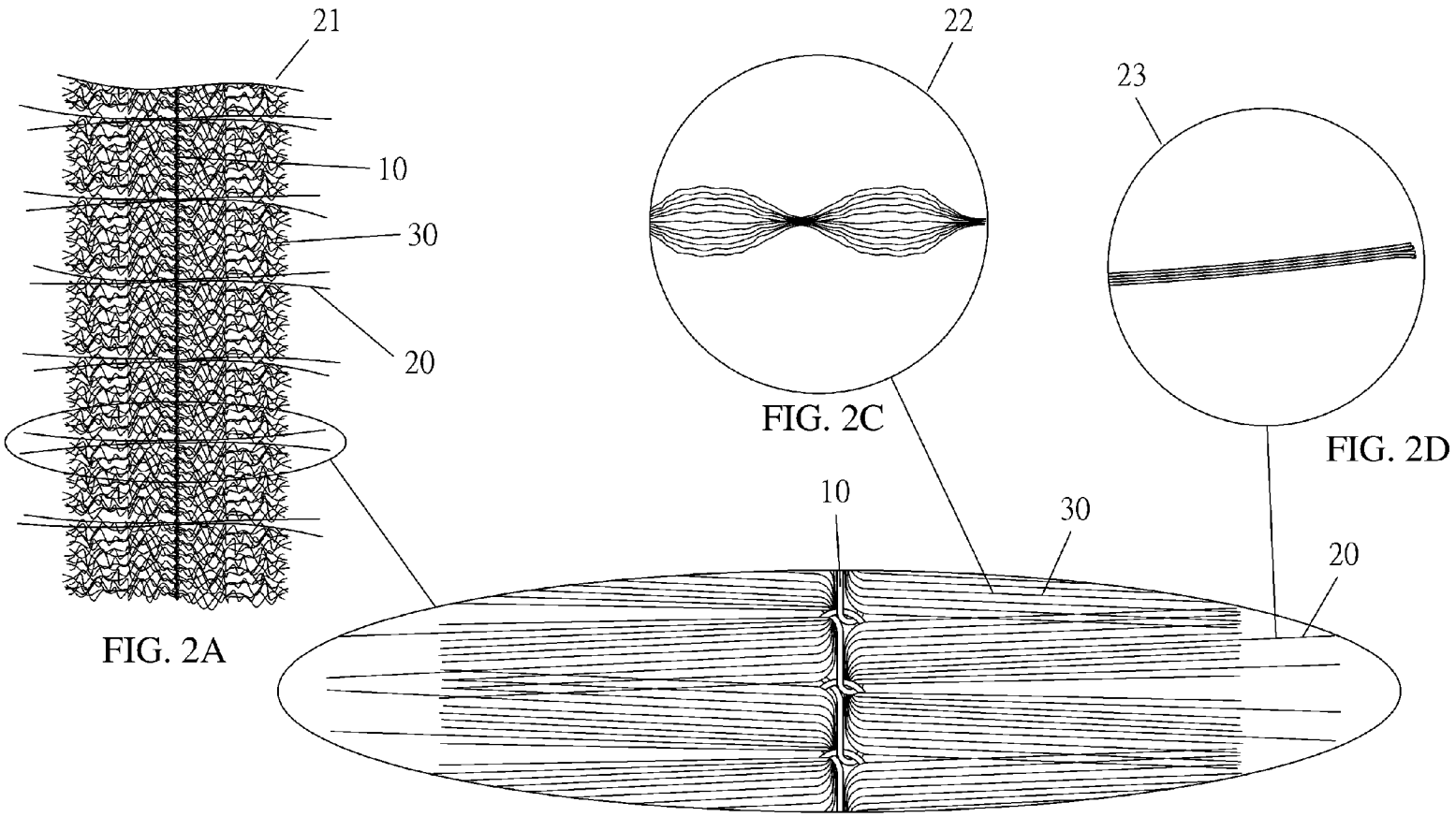
Figure 3:
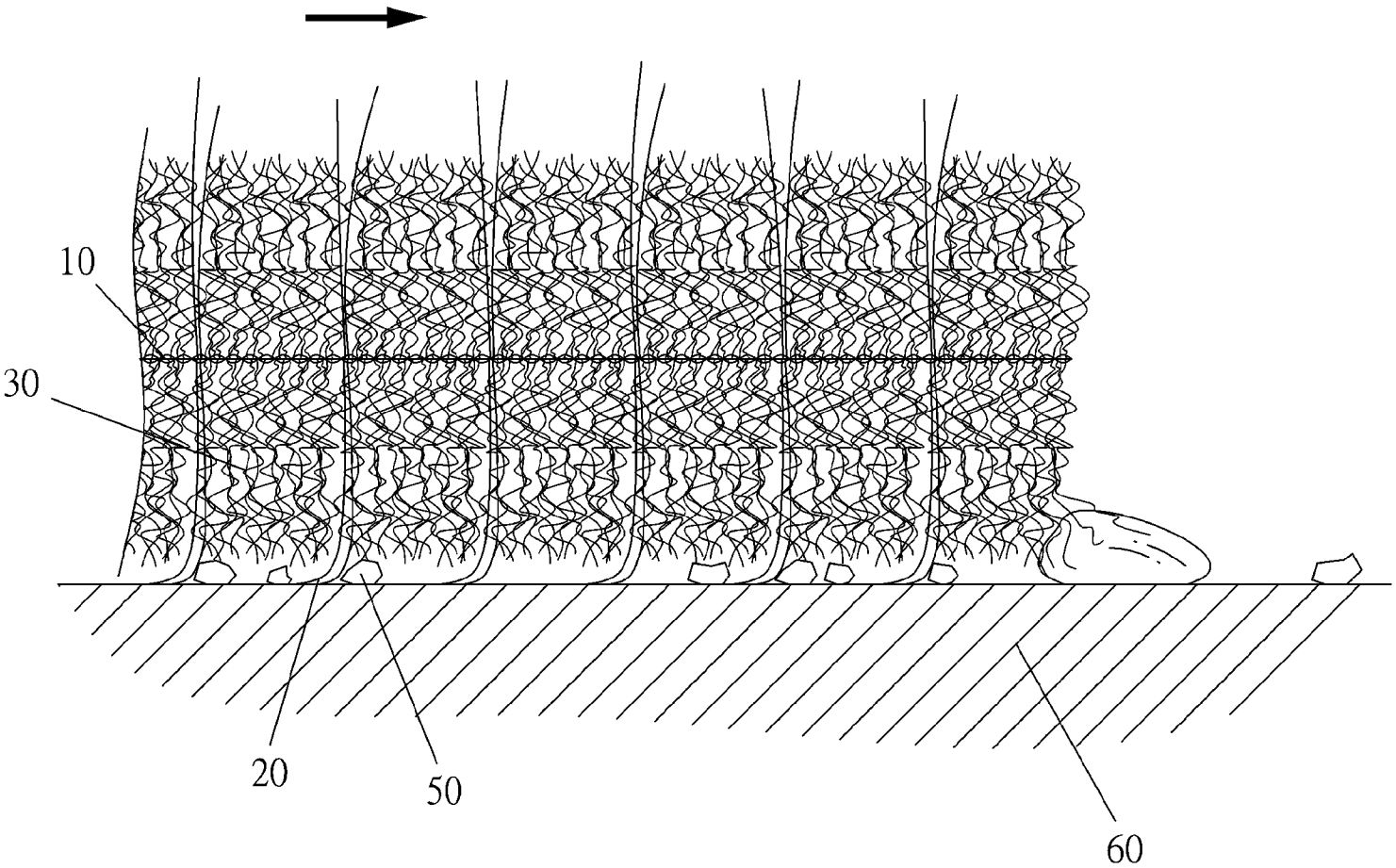
FIG. 3 is a plan view showing the operation of the woven fabric for the mop according to the preferred embodiment of the present invention.
Figures 4A, 4B, 4C, 4D:
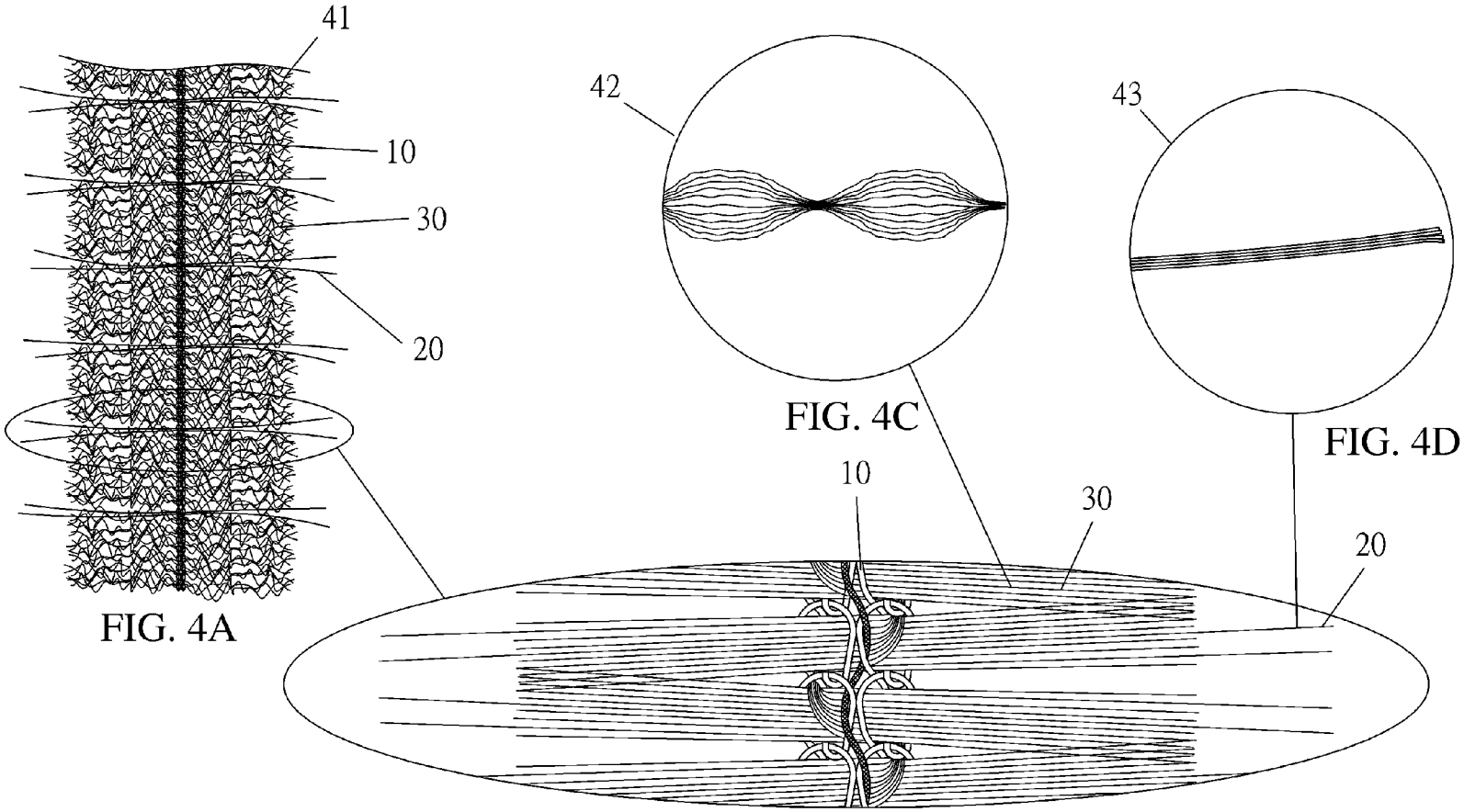

With reference to FIGS. 1 to 4, a woven fabric for a mop cloth according to a preferred embodiment of the present invention comprises: at least one wrap yarn 10 is twisted woven by a plurality of fibers, a plurality of first fiber yarns 20, and a plurality of second fiber yarns 30, wherein each first fiber yarn 20 is a grey yarn with a predetermined hardness, and each second fiber yarn 30 is a textured yarn with a predetermined flexibility, wherein the plural second fiber yarns 30 are sprayed by air to twine plural knots thereon, thereafter the plural second fiber yarns 30 are stretched at a predetermined rate and released (as shown in amplified portions illustrated in FIGS. 2 and 4) to become puffy. In FIG. 2, 21 is amplified view of a portion of the combination of the wrap yarn 10, the first fiber yarn 20 and the second fiber yarn 30. 22 is the amplified view of a portion of the second fiber yarn and 23 is the amplified view of a portion of the first fiber yarn 20. The grey yarn and the textured yarn are made of any one of polyester, nylon, and cotton. In this embodiment, the grey yarn and the textured yarn are made of polyester and are combined together at a rate of 2:10 or at other rates based on using requirements. Taking knitting or crocheting woven fabric for example, it is comprised of more of a plurality of second fiber yarns 30 than a plurality of the first fiber yarns 20, and a plurality of the second fiber yarns 30 and a plurality of the first yarns 20 are woven on the at least one wrap yarn 10 broadwise to form an elongated woven fabric, wherein a length of the first fiber yarn 20 is equal to or longer than the length of the second fiber yarn 30 so that both of the thread ends of the first fiber yarn 20 extends out of the corresponding sides of each wrap yarn 10.

The woven fabric of the present invention is applied in a mop head or a mop disc 40 of various shapes, such that the plural second fiber yarns 30 are puffy to absorb fluids (such as waters, soups, oils, etc.) and to attach dusts strongly as mopping a floor 60, and the plural first yarns 20 scrape hairs, furs or chips 50 on the floor 60 so that the plural second fiber yarns 30 further adhere the hairs or the chips 50, thus cleaning the floor effectively.

Thereby, the woven fabric of the present invention is comprised of a single material or plural materials (such as the grey yarn with the predetermined hardness and the textured yarn with the predetermined flexibility) to absorb the fluids and to scrape objects on the floor, thus enhancing cleaning capacity.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A woven fabric for a mop cloth comprising:

at least one wrap yarn, a plurality of first fiber yarns, and a plurality of second fiber yarns, wherein each second fiber yarn is a textured yarn, and each first fiber yarn is a grey yarn;

the length of each first fiber yarn is equal to or is longer more than the second fiber yarn, such that two thread ends of the first fiber yarn extends out two end sides of the wrap yarn.

2. The woven fabric for the mop cloth as claimed in claim 1, wherein the first fiber yarn and the second fiber yarn are made of a same material, and the second fiber yarn is puffy.

3. The woven fabric for the mop cloth as claimed in claim 1, wherein the first fiber yarn and the second fiber yarn are made of different materials, and the second fiber yarn is puffy.

4. The woven fabric for the mop cloth as claimed in claim 1, wherein there are more of the second fiber yarns than the first fiber yarns.

5. The woven fabric for the mop cloth as claimed in claim 1, wherein the first fiber yarn and the second fiber yarn are made of polyester.

* * * * *